United States Patent [19]

Raymaker

[11] 4,452,339

[45] Jun. 5, 1984

[54] EMERGENCY BODY DESCENDER

[76] Inventor: Charles A. Raymaker, 2300 Leighton Ct., Richmond, Va. 23233

[21] Appl. No.: 383,091

[22] Filed: May 28, 1982

[51] Int. Cl.[3] ..... A62B 1/10

[52] U.S. Cl. ..... 182/232; 182/237; 182/71

[58] Field of Search ..... 182/232, 71, 72, 240, 182/231, 233, 234, 235, 237, 239, 142, 3, 4, 5, 6, 7, 70, 57, 236

[56] References Cited

U.S. PATENT DOCUMENTS

| | | | |
|---|---|---|---|
| 211,875 | 2/1879 | Winkless | 182/142 |
| 355,349 | 1/1887 | Schulte | 182/142 |
| 437,091 | 9/1890 | Carr | 182/240 |
| 635,524 | 10/1899 | Terdoest | 182/237 |
| 662,243 | 11/1900 | Nelson | 182/240 |
| 1,275,053 | 8/1918 | Leiding | 182/57 |
| 1,574,529 | 2/1926 | Abraham | 188/65.1 |
| 1,630,948 | 5/1927 | Karikas | 182/7 |
| 1,760,009 | 5/1930 | Schultz | 182/57 |
| 4,122,917 | 10/1978 | Kendrick | 182/10 |
| 4,327,818 | 5/1982 | Tepsa | 182/233 |

*Primary Examiner*—Ramon S. Britts
*Assistant Examiner*—A. Chin-Shue
*Attorney, Agent, or Firm*—John F. C. Glenn

[57] ABSTRACT

A full length and protected body harness attached by cable wire to an apparatus with a controlled pay out for use in escaping mortal danger in high-rise buildings.

3 Claims, 11 Drawing Figures

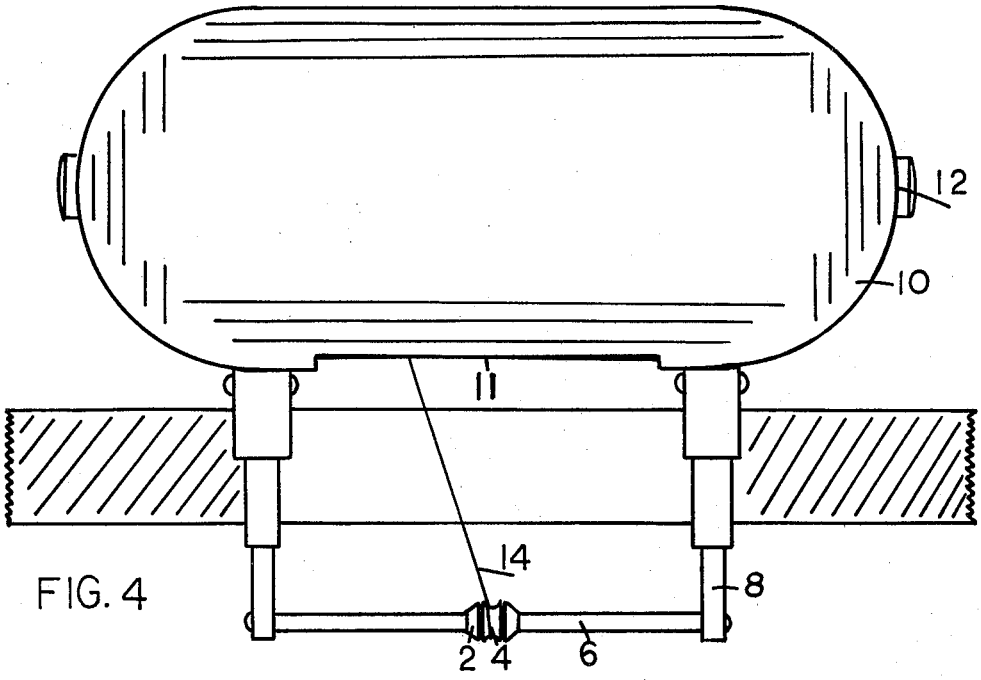
FIG. 4
FIG. 5
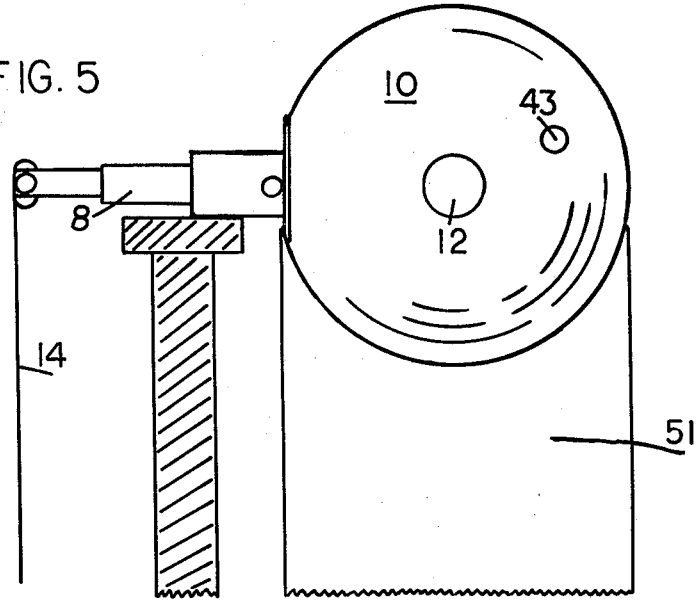

EMERGENCY BODY DESCENDER

BACKGROUND OF THE INVENTION

Death by fire, asphyxiation, and other life threatening situations, has befallen the occupants of high-rise buildings where conventional escape routes could not be used. Panic, fright, and an inability to extricate oneself due to a blocked exit, has resulted in numerous fatalities. Previously available escape systems have proven to be self limiting, difficult to operate under emergency conditions, and generally undependable. Accordingly, a safer, more reliable, and simple to operate system has been needed foor emergency escape from high-rise buildings.

SUMMARY

The invention provides a positive and controlled means for safely escaping a high-rise building via the outside wall. The device, both fixed and portable version, is positioned on the inside window frame, balcony, or roof, and attached by cable wire to a fire resistant harness. The evacuee first slips into the full length harness, which is preattached to the device containing the coiled cable wire. The device is either permanently anchored where it is stationed or it is provided with means for anchoring it to the building. The evacuee then opens or eliminates the window with the specially provided equipment and immediately exits and descends. The rate of descent is controlled by a braking mechanism mounted next to the anchoring mechanism, and activated by the evacuee's weight.

Other details and advantages of the invention will become apparent as the following description of present preferred embodiments thereof proceeds.

DESCRIPTION OF THE DRAWINGS

The accompanying drawings illustrate schematically presently preferred embodiments of the invention as follows:

FIG. 4 is a top view of the lowering apparatus, shown in FIG. 1, with the lowering arms extended, positioned near a window which is shown in horizontal section through its side walls.

FIG. 5 is a side view of the apparatus shown in FIG. 4, with the window sill and lower wall shown in vertical section, and the other portions of the window and wall omitted.

DETAILED DESCRIPTION OF THE PRESENTLY PREFERRED EMBODIMENT

Figure 1:
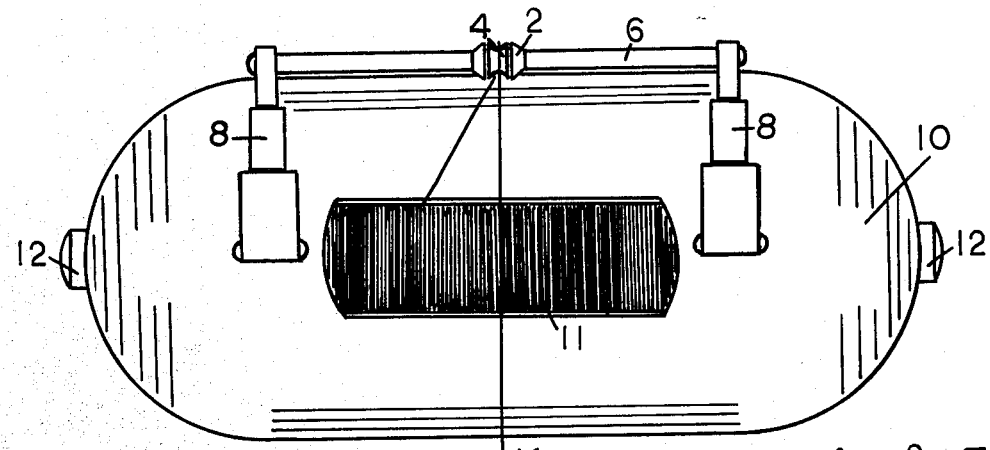
FIG. 1 is a front view of the lowering apparatus and harness, before being mounted in a window.
Figure 2:
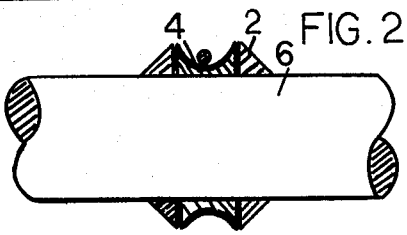
FIG. 2 is an enlarged view, partially broken away, of the cable guide and pulley as shown in FIG. 1.
Figure 3:
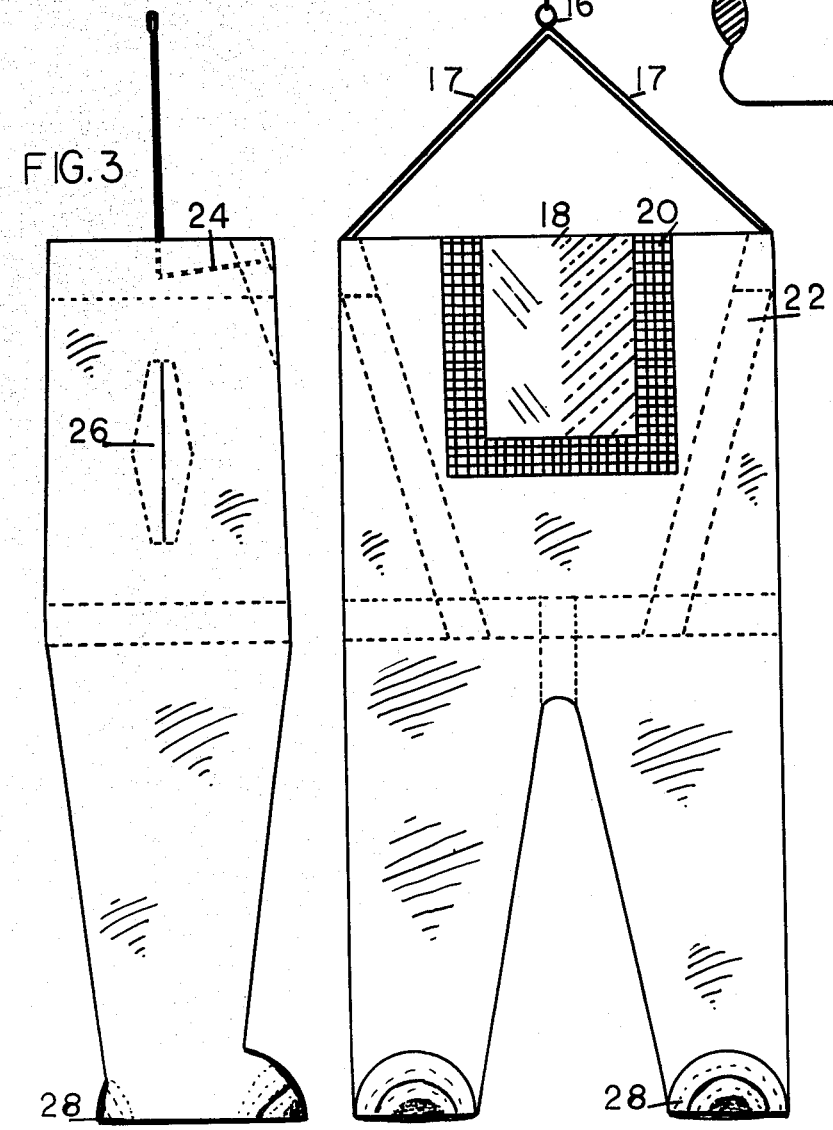
FIG. 3 is a side view of the harness as shown in FIG. 1.
Figure 6:
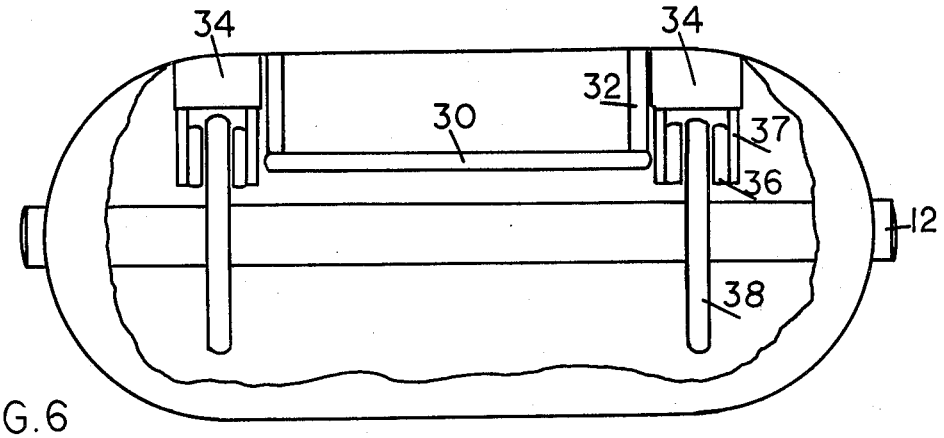
FIG. 6 is a partially broken away front view of the apparatus as shown in FIG. 1, with the front wall of the casing, the lowering arms, and the cable wire omitted.
Figure 7:
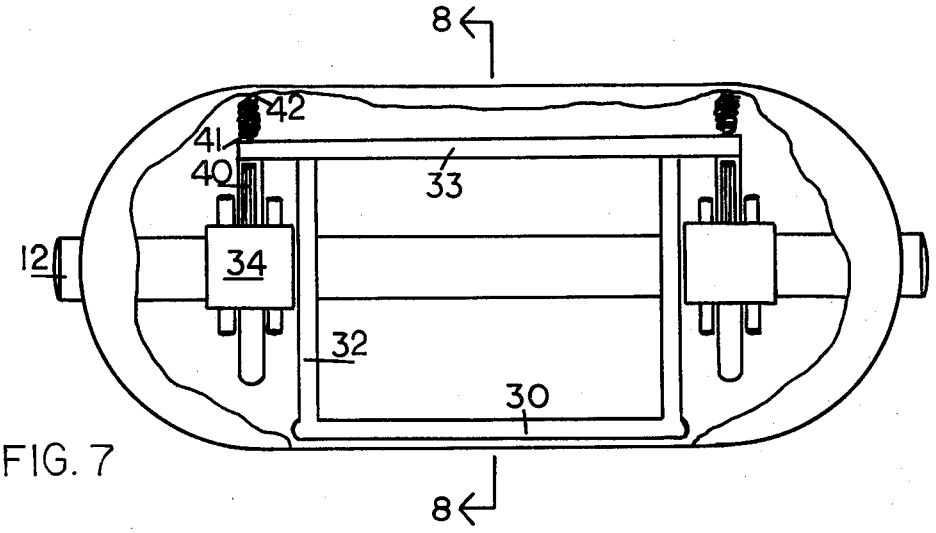
FIG. 7 is a top view of what is shown in FIG. 6.

Referring now more particularly to the drawings and initially to FIG. 1, there is shown semi-conical members 2 rigidly connected to a lowering bar 6 and a pulley 4 journaled on bar 6 between the members 2. The ends of lowering bar 6 are connected to two parallel telescoping arms 8. The telescoping arms are mounted on a reinforced tubular casing 10 on opposite sides of opening 11 through the side of casing 10. The base of each of the arms 8 is attached to casing 10 to pivot about an axis parallel to the central axis 10.

A shaft 12 extends coaxially through the tubular casing 10 and is journaled in the ends of the casing. Cable wire 14 is attached at one end to shaft 12 and is wound around it in a coil 14'. The other end of cable 14 is connected to a harness ring 16. The harness ring is rigidly connected to the side of two divergent rods 17 and the opposite ends of the rods are attached to a fire resistant body harness preferably about five and one half feet long. Centered on the harness is a clear vinyl face shield 18. On three sides of the face shield is a mesh air screen 20. Reinforcing seams 22 extends down from their connection with the bent lower ends of the harness ring rods 24. Arm openings 26 provide access to the outside of the body harness. Reinforced foot receptacles 28 provide protection against friction where contact may be made with a portion of the building. On the underside of the foot receptacles are holes (not shown) which permit the escape of water which might be directed into the top of the harness by a fire hose.

Figure 8:
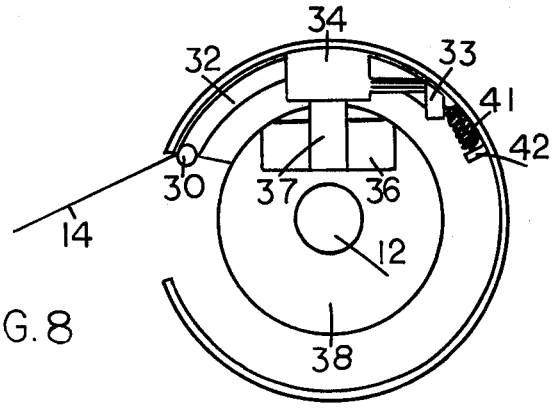
FIG. 8 is a section on line 8—8 in FIG. 7.
Figure 9:
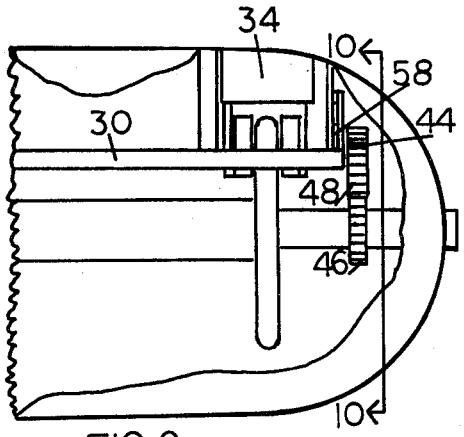
FIG. 9 is a view of a modified form of the apparatus shown in FIG. 6, with an optional rewind mechanism added, and the sensor bar elongated.

As shown in FIG. 8, the coiled cable wire passes over a weight sensor bar 30. The weight sensor bar is connected on both sides to the ends of two relay bars 32 which extend in arcs coaxial with the tubular casing and are mounted for slideable endwise movement around their axis. The opposite ends of relay bars 32 are connected to a bar 33. The bars 30 and 32 control a brake system consisting of two independently spaced units 34 which operate by applying the pressure of pads 36 to operate sides of rotating discs 38 rigidly attached to the central shaft 12. Each pair of pads is actuated by calipers 37 controlled by hydraulic pressure supplied by pistons 40 when they are pressed by the bar 33 connecting the curved relay bars 32 in response to downward movement of sensor bar 30. A spring 41 is attached on one end to bar 33 and on the other end to a fixed point 42 inside the tubular casing. The spring tension will cause a release in brake pressure only when sensor bar 30 detects a minimum amount of weight on the cable. The brakes are calibrated so that whether the weight of a person in the harness is great or small, the resistance of the brake increases or decreases enough to maintain a generally even rate of descent, regardless of what weight is in the harness, within the design limits.

Figure 10:
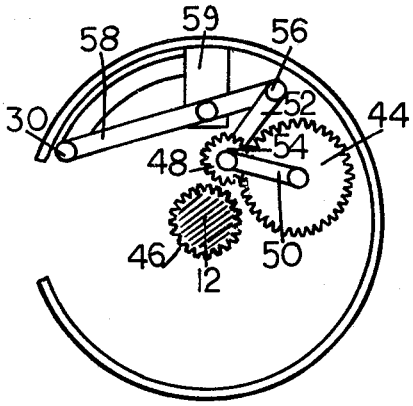
FIG. 10 is a section on the line 10—10 in FIG. 9, partially broken away and omitting the braking mechanism.
Figure 11:
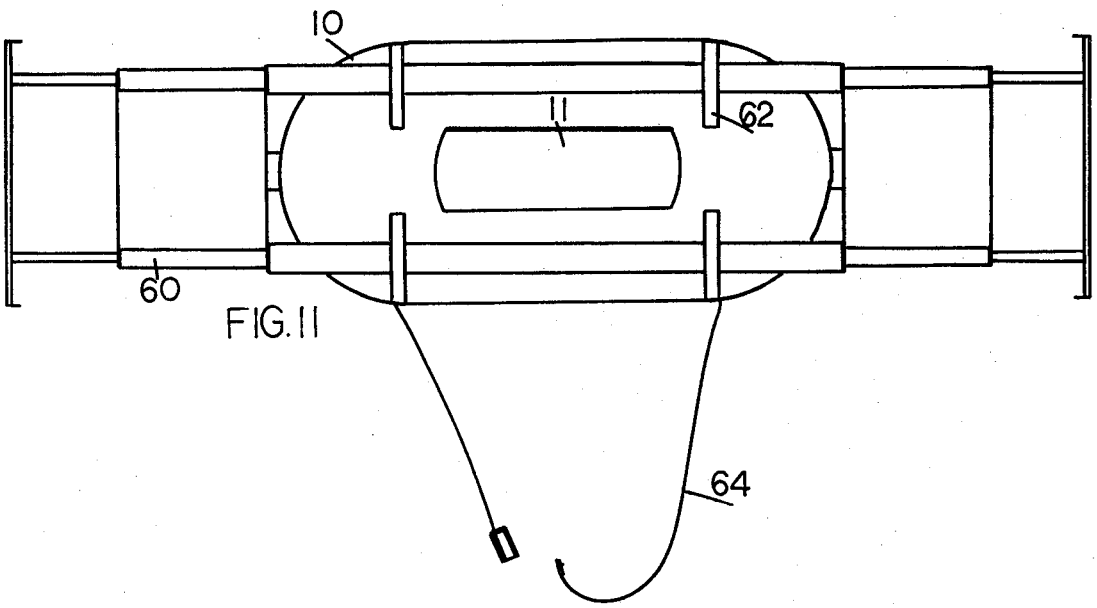
FIG. 11 is a front view of the lowering apparatus, shown in FIG. 1, in reduced scale, with telescoping poles added and the cable wire and lowering arms omitted.

The apparatus may include means to rewind the cable after the previous descent has been completed, and the evacuee has removed himself from the body harness. For example, a crank (not shown) may be inserted into a rewind port 43 (FIG. 5) through casing 10 for manually turning a gear 44 (FIG. 10) mounted at one end of casing 10 for rotation about a fixed axis parallel to the central shaft 12. A gear 46 is carried on and attached to shaft 12, and a spur gear 48 is journaled at one end of an arm 50 pivoted about the axis of gear 44 so that gears 44 and 48 are always in mesh, but gear 46 only meshes when it is carried out by arm 50 into engagement with gear 48. Pivotal movement of arm 50 is controlled by an arm 52 connected at one end to arm 50, and at the other end to a roller 56 journaled on one end of arm 58 which is pivotally mounted at its mid portion on a fixed support 59. The other end of arm 58 is connected to the sensor bar 30 so that when the sensor bar responds to pressure from cable 14, the arm 58 carries the spur gear out of mesh with gear 46 in order to prevent someone from manually winding back a filled harness before it has discharged its passengers. Once the passengers are out, the release of pressure on cable 14 will allow the gear train 46, 48, and 44 to operate for rewinding.

The casing 10 may be permanently attached to a support 51 anchored at the base of a window (FIG. 5). Alternatively, it may be portable and anchored inside a window by telescoping poles 60 held by straps 62 against the front of casing 10. The straps encircle the casing and telescoping poles but pass into and out of the casing at points above and below the base of lowering arms 8. When in use, the poles 60 are positioned between the casing and the window opening and extended beyond both sides of the window opening. Safety wire 64 may also be provided to attach the casing 10 or the straps 62 to any available fixture such as a radiator.

In an actual emergency, the evacuee will first slip into the body harness which is preconnected to the apparatus (FIG. 1). In the premounted apparatus as seen in FIG. 5, the evacuee may rotate the lowering bar 6 against the window glass in order to break and remove it. The evacuee then crawls feet first through the opening and may use lowering bar 6 to facilitate his egress. Going out over the extension bar would have the advantage of no entanglements in the way. Two additional bars, parallel to lowering bar 6 and the central axis of casing 10 and rigidly attached to the end sleeves of arms 8, could serve as a bridge for the egressing evacuee. Going out between the arms would be the other possibility, with due care to avoid catching on the portion of the cable wire passing from the casing to the lowering bar.

The entire mechanism operates in such a manner that a light body will descend at approximately the same rate as a heavy or plural number of bodies within the design limits of the apparatus. Accordingly, a second harness may be attached to the harness ring 16 prior to egressing. If that is contemplated, and also for simplicity of construction, it may be desired to substitute one piece arms for the telescoping arms 8.

While present preferred embodiment and practices of the invention have been illustrated and described, it will be understood that it may be otherwise embodied and practiced within the scope of the following claims.

I claim:

1. Apparatus for emergency descent from a building, comprising a coil of cable, means at one end of the cable for attaching a harness, means attached to the other end of the cable and rotatable to permit the cable to unwind to lower the harness, means for braking rotation of said rotatable means and thereby controlling the rate of descent of the harness, means for mounting the rotatable means and braking means, means for anchoring the mounting means to a building so that the rotatable means and braking means remain where they are anchored while the cable is unwound to lower the harness, including means for manually rewinding the cable and means responsive to cable tension induced by weight in the harness to prevent rewinding of the cable while the harness is occupied and descending.

2. Apparatus according to claim 1, including means for detecting a release of weight in the harness, and means activated by said detecting means for engaging the rewind means as a result of the release of weight in the harness.

3. Apparatus for emergency descent from a building, comprising a coil of cable, means at one end of the cable for attaching a harness, means attached to the other end of the cable and rotatable to permit the cable to unwind to lower the harness, means for braking rotating of said rotatable means and thereby controlling the rate of descent of the harness, means for mounting the rotatable means and braking means, means for anchoring the mounting means to a building so that the rotatable means and breaking means remain where they are anchored while the cable is unwound to lower the harness, and a harness comprising a fire resistant material for protecting the face and body of a person in the harness, a mesh air screen for providing an air supply to enter the harness, a vinyl shield for providing visibility from within to the outside of the harness, and rigid diverging rods attaching the harness to the cable wire.

* * * * *